United States Patent [19]

Bass et al.

[11] 4,077,339

[45] Mar. 7, 1978

[54] CARTRIDGE SEWING MACHINE ACCESSORY

[75] Inventors: Sidney Bass, Los Angeles; Herbert May, Torrance; Hubert Allen Rich, Westminster, all of Calif.

[73] Assignee: Mattel, Inc., Hawthorne, Calif.

[21] Appl. No.: 761,380

[22] Filed: Jan. 21, 1977

[51] Int. Cl.[2] ..... D05B 23/00

[52] U.S. Cl. ..... 112/121.27; 112/270; 112/258

[58] Field of Search ..... 112/121.27, 121.26, 112/258, 259, 270, 302, 169; 242/137, 138, 71.1

[56] References Cited

U.S. PATENT DOCUMENTS

| | | | |
|---|---|---|---|
| 2,558,873 | 7/1951 | Mollis | 112/169 |
| 3,385,247 | 5/1968 | Johnson et al. | 112/270 |
| 3,515,081 | 6/1970 | Miller | 112/121.27 X |
| 3,749,039 | 7/1973 | Fritts | 112/302 |
| 3,856,224 | 12/1974 | Vanderaa | 112/121.27 X |

*Primary Examiner*—Werner H. Schroeder
*Assistant Examiner*—Peter Nerbun
*Attorney, Agent, or Firm*—John G. Mesaros; Stephen L. King; Max E. Shirk

[57] ABSTRACT

A sewing machine having a cartridge containing a spool of thread and a pre-threaded needle mounted inside of the head, the cartridge having the lower end thereof terminating in proximity to the fabric to be worked upon. The cartridge is provided with integral means for receiving a spool carrying ribbon-like material, the cartridge having a channel means integral therewith adjacent the aperture of the cartridge through which the needle passes, the spool of ribbon being so mounted, and the channel so configured, that the natural unwinding tendency of the ribbon automatically positions the ribbon on the fabric in the path of the needle.

4 Claims, 3 Drawing Figures

CARTRIDGE SEWING MACHINE ACCESSORY

CROSS REFERENCE TO RELATED APPLICATION

This patent application is related to a patent application filed concurrently herewith and assigned to the assignee of the instant invention, such patent application being entitled "Sewing Machine" by Sidney (NMI) Bass and Hubert Allen Rich, Ser. No. 761,381, filed Jan. 21, 1977.

BACKGROUND OF THE INVENTION

The background of the invention will be discussed in two parts:

1. Field of the Invention

This invention relates to sewing machines and more particularly to a cartridge for sewing machines.

2. Description of the Prior Art

Sewing machines utilizing cartridges or cassettes for carrying a spool of thread, or a spool of thread and a needle are shown in U.S. Pat. Nos. 3,385,247 and 3,749,039, both patents being described in the above-referenced co-pending application.

Devices for feeding strips of ribbon or the like have been devised as attachments to or modifications of existing sewing machines, such devices being shown in U.S. Pat. Nos. 1,731,074 issued Oct. 8, 1929 to Maier; 1,748,770 issued Feb. 5, 1930 to Horning; 1,849,797 issued Mar. 15, 1932 to Hake; 3,154,033 issued Oct. 27, 1964 to Roy; 2,961,186 issued Nov. 22, 1960 to Sayles; and 3,847,099 issued Nov. 12, 1974 Braun. The prior art known to applicant is listed by way of illustration and not of limitation, in a separate communication to the Patent Office.

It is an object of the present invention to provide a cartridge for a sewing machine.

It is another object of this invention to provide a cartridge having means integral therewith for dispensing ribbon-like material.

SUMMARY OF THE INVENTION

The foregoing and other objects of the invention are accomplished by providing a sewing machine having a cartridge mounted in the side of the head, the cartridge containing therein a spool of thread and a pre-threaded needle on a needle carrier adapted for reciprocation within the cartridge with the needle passing out of the cartridge through an aperture in the bottom thereof. The cartridge is so dimensioned that the spacing between the aperture and the bed of the machine is in close relation generally to preclude entry therebetween of fingers. The cartridge is provided with a recess for rotatably receiving a spool carrying a strip of ribbon-like material, the strip passing through a channel formed in an edge of the cartridge in proximity to the aperture, the spool being positioned on the cartridge in a direction of rotation so that the tendency of the strip to resist unwinding automatically directs the strip inwardly toward the aperture.

Other objects, features and advantages of the invention will become apparent upon a reading of the specification when taken in conjunction with the drawings in which like referenced characters refer to like elements in the several views.

DESCRIPTION OF THE PREFERRED EMBODIMENT

Figure 1:
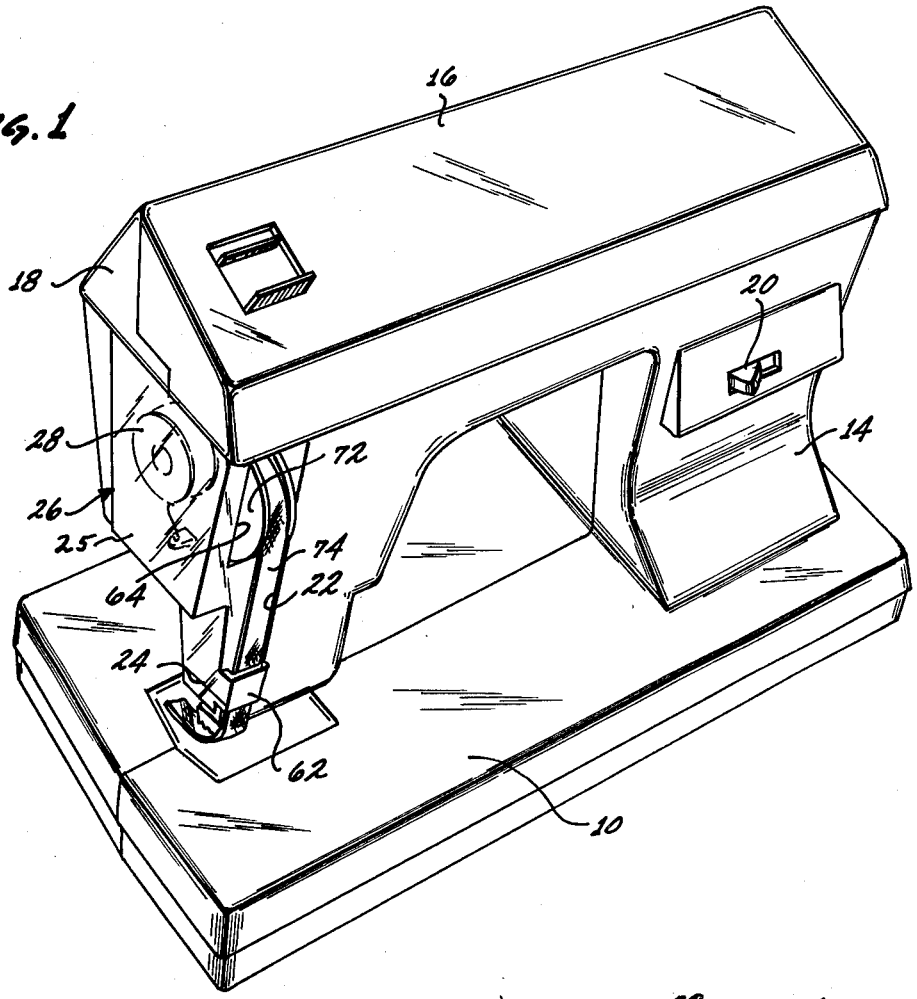
FIG. 1 is a perspective view of a sewing machine having a cartridge according to the invention.

Referring now to the drawings and particularly to FIG. 1, there is shown a sewing machine which includes a main platform or work-supporting bed 10 having an integral upwardly extending standard 14, a bracket arm extending generally parallel to the bed 10 from the standard 14, the other end of which terminates in a vertically depending head 18. Generally the sewing machine is electrically operated by means of a switch 20 which connects batteries therein to a motor for operation of the machine. The structural details pertaining to the construction and operation of the sewing machine of FIG. 1 are fully shown and described in the above referenced co-pending application entitled "Sewing Machine".

Figure 2:
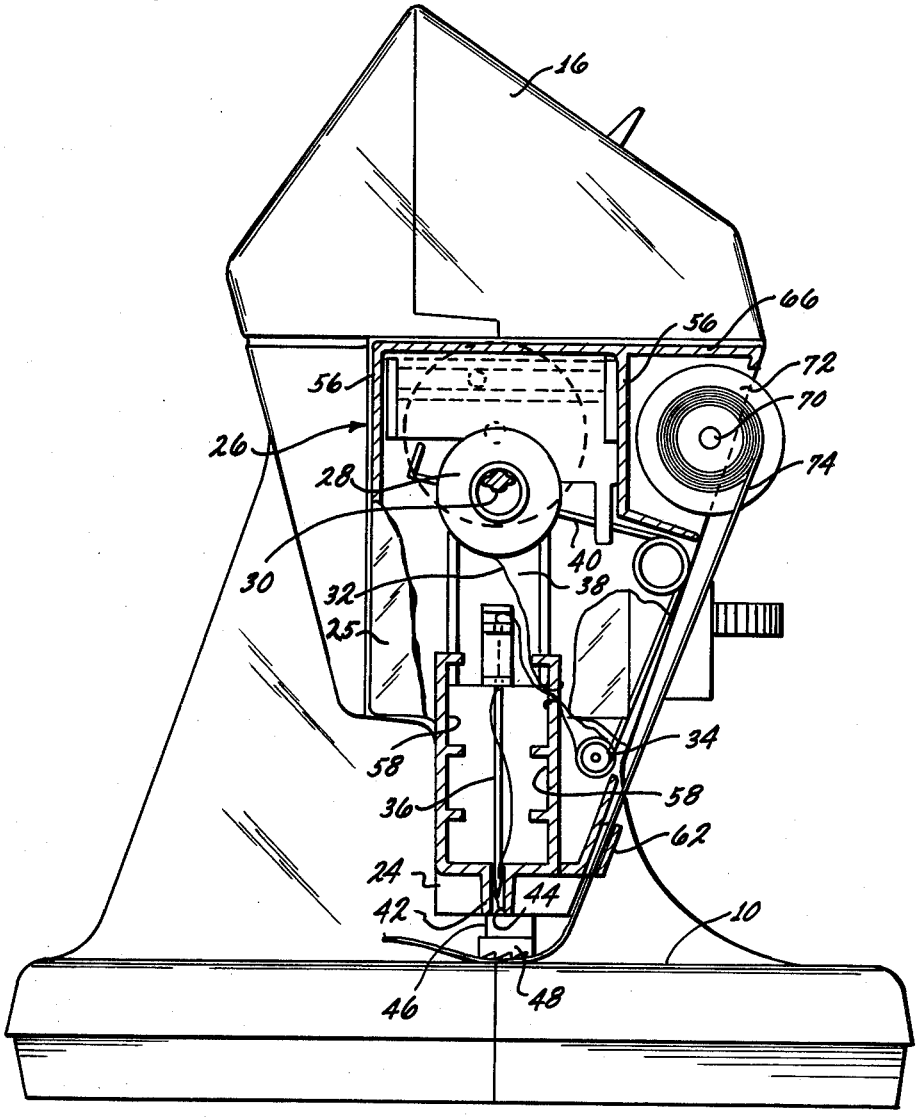
FIG. 2 is an end view of the sewing machine of FIG. 1, partially in cross section and partially broken away to show the cartridge details.

In any event, the head 18 is provided with a recessed portion 22 in the side thereof, the recess 22 having a planar vertical surface with an outwardly extending ledge portion 24, the ledge 24 being adapted to engage the lower edge of a cartridge member 26 with the rear surface of cartridge 26 abutting against recess 22. The cartridge 26 can be retained within the recess 22 by any conventional means such as detents or the like. The cartridge 26 contains therein a spool of thread 28 (see also FIG. 2) which is rotatably received on a shaft projection 30 integrally formed with the front transparent cover 25 of cartridge 26. The thread 32 from spool 28 is suitably wound about a tensioning device 34 formed within cartridge 26 and more fully described in the above referenced co-pending application, the thread 32 then being passed through the eye of a needle 36 secured to a needle carrier 38 mounted for reciprocating movement on a vertical line within cartridge 26 against the force of a bias spring 40. In side elevation, as can be seen in FIG. 2, the cartridge 26 has a right angled edge generally fitting within a mating portion of the recessed portion 22 with the edge of cover 25 adjacent the operator position diverging downwardly toward the lower portion of cartridge 26 which is provided with a neck portion 42 through which extends an aperture 44 through which the needle 36 passes during its reciprocation. The neck portion 42 extends through an aperture formed within the ledge 24 integral with the side of the head 18, the lower surface of ledge 24 being generally parallel to bed 10 with a space therebetween defining a throat 46 through which the fabric to be sewn is passed. A suitable material advance foot 48 is provided for incrementing the fabric during the stitching operation.

Figure 3:
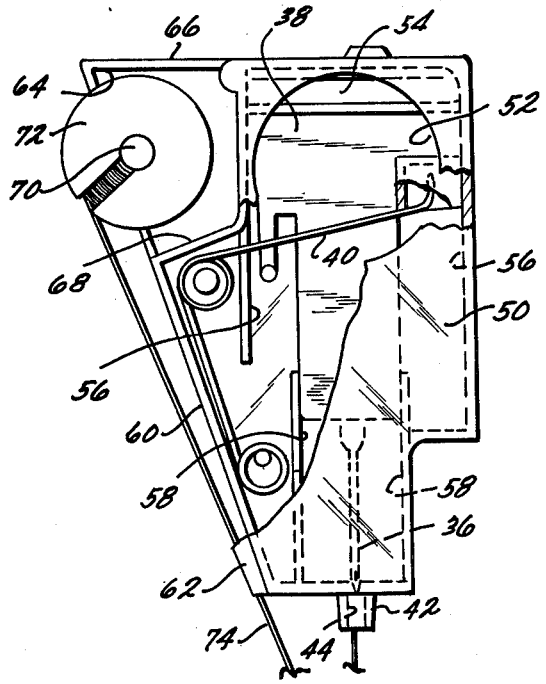
FIG. 3 is a rear view of the cartridge used in the sewing machine of FIG. 1.

Referring to FIGS. 2 and 3 the details pertaining to the construction of the cartridge 26 will be discussed. As previously mentioned the cartridge 26 has a transparent cover 25 engaging a generally planar rear surface or back wall 50. The back wall 50 is provided with an enlarged aperture 52 through which a crank pin extends from within the machine to actuate the needle carrier 38 by means of the crank pin engaging a crank pin groove 54 formed in the rear surface of the needle carrier 38 and accessible through aperture 52. The needle carrier 38 is vertically reciprocated with the upper portion of needle carrier 38 fitting between opposing parallel sidewalls 56 and the lower portion of needle carrier 38 sliding between opposing guide ribs 58. The needle 36 is of conventional configuration and is press fit into a suitably formed aperture within the bottom edge of needle carrier 38. The needle 36 is provided with an eye adjacent the point thereof through which the thread 32 passes out through the aperture 44 for grasping by an operator. As a consequence the cartridge contains a pre-threaded needle along with a full spool of thread 28 for immediate use by an operator. A more detailed description of the cartridge 26 and the operating of the sewing machine is provided in the above-referenced co-pending application entitled "Sewing Machine" which is incorporated herein by reference.

The main surface of cover 25 is generally parallel to the rear surface or back wall 50 to form a housing with the interconnecting edges being generally perpendicular to back wall 50. The front edge 60 of cartridge 26 is downwardly tapered toward the needle 36 and formed integrally with the forward edge 60 at the lower end thereof is a slotted member or channel 62 in proximity to the aperture 44 formed within neck portion 42 of cartridge 26. Formed adjacent the upper front edge of cartridge 26 is a recess 64 between the inner surface of upper edge 66 of cartridge 26, the perpendicular outer surface of sidewall 56 and an integral outwardly extending short wall 68. The back wall 50 of cartridge 26 is suitably cut away to provide access to the recess 64 so-formed with the cartridge 26 separated or out of engagement with the recess 22 formed in the head 18 of the sewing machine. Extending inwardly into the recess 64 so-formed, from the front wall of the transparent cover 25 is an integral shaft projection 70 adapted for rotatably receiving thereon a spool 72 containing a strip of ribbon-like material 74 which is suitably fed through channel 62 to be in proximity to needle 36. The dimension of shaft 70 is equal to or less than the overall width of front edge 60 and by means of this construction the spool 72 is assembled within recess 64 with the cartridge 26 separated from the sewing machine. With the spool 72 in place and the cartridge 26 engaging the sewing machine head 18 within recess 22 the adjacent generally planar surface of recess 22 is generally parallel to the broad surface of transparent cover 25 thereby forming a compartment rotatably retaining spool 72 within recess 64 between the sidewalls of the compartment so-formed.

As shown in FIG. 2 the spool 72 is preferably positioned on shaft 70 so that ribbon 74 is withdrawn from the spool 72 as spool 72 rotates in a clockwise direction. In this manner when the free end of ribbon 74 is positioned adjacent bed 10 the natural tendency of the ribbon 74 is to curve inwardly toward throat 46, thereby providing relative simplicity to the use of the cartridge. The position of channel 62 and, of course, ribbon 74 is directly in line with the line of travel of fabric passing through throat 46, the fabric moving from right to left as viewed in FIG. 2. In FIG. 2 the ribbon 74 is shown beneath advance foot 48 which would be the operative position for sewing the ribbon 74 on a fabric (not shown) which would normally be positioned between the ribbon 74 and the bed 10. The ribbon 74 may be any suitable spool of ribbon-like material or the like. The spool 72 is removable and replaceable within cartridge 26 to accomodate the matching of different colors of ribbons to the color of the thread contained on the spool 28 within cartridge 26.

While there has been shown and described a preferred embodiment it is to be understood that various other adaptations and modifications may be made within the spirit and scope of the invention.

What is claimed is:

1. In a cartridge for use with a sewing machine having a recessed surface in the side of the head thereof abuttingly receiving a first planar surface of the cartridge, the cartridge having a second generally parallel surface with interconnecting edges to define a housing having a reciprocable needle carrying member generally wholly contained within said cartridge the needle being reciprocable out through an aperture in the bottom of the cartridge, one of the interconnecting edges being a front edge of the cartridge, said cartridge comprising:

a recess formed within the upper portion of said cartridge adjacent the front edge;

means within said recess for receiving a spool of ribbon-like material with said cartridge separated from said sewing machine and for rotatably retaining said spool with said cartridge received in said recessed surface; and channel means on the front edge of said cartridge adjacent the needle aperture for passage therethrough of said ribbon-like material in proximity to the needle.

2. The combination according to claim 1 wherein said recess is defined by a portion of said second surface and a cut away portion of said first surface of said cartridge.

3. The combination according to claim 2 wherein said means within said recess includes a shaft formed integrally with said second surface generally perpendicular thereto.

4. The combination according to claim 3 wherein said channel means are integrally formed in said front edge.

* * * * *